US006354863B2

(12) United States Patent
Aoyama

(10) Patent No.: US 6,354,863 B2
(45) Date of Patent: Mar. 12, 2002

(54) INSULATION-DISPLACEMENT TERMINAL FITTING AND A PRODUCTION METHOD THEREFOR

(75) Inventor: Masahiko Aoyama, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/740,327

(22) Filed: Dec. 18, 2000

(30) Foreign Application Priority Data

Dec. 17, 1999 (JP) ..... 11-359732

(51) Int. Cl.[7] ..... H01R 4/24
(52) U.S. Cl. ..... 439/395; 439/397
(58) Field of Search ..... 439/397, 398, 439/400, 402, 403, 924.1, 405, 406, 404, 408

(56) References Cited

U.S. PATENT DOCUMENTS 3,902,154 A * 8/1975 McKee ..... 439/401
4,040,702 A 8/1977 McKee et al. ..... 439/399
4,385,794 A * 5/1983 Lucius ..... 439/399
4,427,251 A * 1/1984 Mathe et al. ..... 439/397
4,660,917 A * 4/1987 DeRoss et al. ..... 439/404
4,840,578 A * 6/1989 Sato ..... 439/395
4,940,425 A * 7/1990 Hass et al. ..... 439/397
5,133,672 A * 7/1992 Nelligan, Jr. et al. ..... 439/399

FOREIGN PATENT DOCUMENTS

EP 0 534 276 A2 9/1992
EP 0 722 197 A2 12/1995
EP 0 845 836 A1 11/1997

* cited by examiner

*Primary Examiner*—Tulsidas Patel
(74) *Attorney, Agent, or Firm*—Anthony J. Casella; Gerald E. Hespos

(57) ABSTRACT

An insulation displacement terminal fitting has V-shaped blade portions (17) each of which is formed by two blades (19) that interest at contacting edges (20). V-shaped cutting edges (21) of the blades (19) have different angles of inclination (α, β) when viewed in the longitudinal direction of a wire (16). Thus, the cutting edges (21) contact a resin coating (16A) of the wire (16) at different timings while the wire (16) is being pushed in. The blades (19) of each blade portion (17) do not simultaneously come into contact with the resin coating (16A). Thus, a resistance during cutting can be small.

14 Claims, 5 Drawing Sheets

INSULATION-DISPLACEMENT TERMINAL FITTING AND A PRODUCTION METHOD THEREFOR

BACKGROUND OF THE INVENTION

1. Field of the Invention

The present invention relates to an insulation displacement terminal fitting and to a method for producing an insulation displacement terminal fitting.

2. Field of the Invention

Some insulation displacement terminal fittings are produced by applying plating to a surface of a planar conductive metal plate of a specified thickness. The metal plate then is stamped to specified shape. The stamping is carried out to define two U-shaped slits in portions of the metal plate that will define side walls of the terminal fitting. The cut portions surrounded by the U-shaped slits then are bent away from the plane of the plate to define blades, and the portions of the plate that will define the side walls are bent toward one another and into substantially parallel relationship. Thus, inwardly facing edges of the blades are substantially opposed to each other and act as cutting edges.

The opposed cutting edges of the blades are intended to contact the core of a wire that is urged into the space between the blades. These cutting edges are fractured surfaces formed at the time of stamping and are not protected by plating. Thus, there is a problem of contact reliability if these unplated surfaces are brought into contact with the core. Accordingly, plating generally has been applied to the fractured surfaces. Such plating at a later stage means an increased number of operation steps, which results in higher production costs.

In view of the above, insulation displacement terminal fittings that do not require plating at a later stage were developed. One example of such terminal fittings is disclosed in Japanese Unexamined Patent Publication No. 50(SHO)-114592. This terminal fitting is formed by striking the side walls with a press to form inwardly projecting V-shaped blade portions that project from the corresponding side wall of the terminal fitting. Each V-shaped blade portion has a pair of substantially triangular blades that meet at a fold line. The fold line between the blades serves as a contacting edge. Each blade also has an upwardly facing cutting edge. A wire can be pushed between an opposed pair of such V-shaped blade portions. As a result, the cutting edges of the blades cut a resin coating of the wire to expose the core. The contacting edge of each blade portion then contacts the exposed core. The folded contacting edges of the V-shaped blade portions remain plated, and thus plating at a later stage is unnecessary.

Blades formed by cutting and bending portions of the side walls are L-shaped when viewed in a direction in which the wire is pushed in. Thus, resistance created during insulation displacement is relatively small because the planar blades contact the resin coating of the wire while the wire is being pushed in. However, the blade portions formed by embossing are V-shaped when viewed in the direction in which the wire is pushed in. Accordingly, an insulation displacement resistance is disadvantageously large.

In view of the above, an object of the present invention is to provide an insulation displacement terminal fitting and a production method to reduce an insulation displacement resistance of V-shaped blade portions.

SUMMARY OF THE INVENTION

The subject invention is directed to an insulation displacement terminal fitting with at least one pair of blade portions.

The blade portions area arranged such that a wire can be pushed between the blade portions in the pair at an angle different from 0° and 180° to the longitudinal axis of the wire, and preferably substantially normal to the longitudinal axis of the wire. Each blade portion comprises two blades that meet at a contacting edge. Each blade has a cutting edge that faces in a wire pushing direction and that extends from the contacting end of the blade portion. An insulation coating of a wire pushed between the two blade portions in a pair can be cut by cutting edges of the blades so that the core of the wire can be brought into contact with the contacting edges. The cutting edges of the two blades are arranged to contact the insulation coating at different times as the wire is pushed between the blade portions in the pair.

According to a preferred embodiment, the insulation displacement terminal fitting comprises side walls, and the blade portions are formed by bending or embossing portions of side walls inwardly. The blade portions preferably project substantially in a V-shape when viewed in a pushing or insertion direction of the wire.

Most preferably, the contacting edges extend continuously in the wire pushing direction from the end of the blades most distant from the respective side wall.

The two blades of the V-shaped blade portion are configured to avoid simultaneously coming into contact with the resin coating as the resin is being cut. Rather, one blade of a blade portion contacts and cuts the insulation coating before the other blade of the blade portion. Thus, resistance during cutting can be small.

The cutting edges of the two blades in each blade portion preferably form a substantially V-shape and are inclined from a corresponding side wall of the insulation displacement terminal fitting toward the corresponding contacting edge. The inclination is aligned in a direction to guide the wire laterally, and the contact timings of the cutting edges of the two blades in the blade portion with the insulation coating are determined by the angles of inclination of the cutting edges. The inclination of the cutting edges of the blades enables the position of the wire to be corrected even if the wire is displaced with respect to its widthwise direction.

The position or height of the blades along the wire pushing direction can be changed to vary the timing of the contact between the insulation coating and the cutting edges of the blades.

Each blade portion in the pair is configured to bring one blade into contact with the resin coating before the other blade in the respective blade portion. Thus, an insulation displacement resistance is smaller as compared to a case where such a sequential cutting operation is performed only at one of the blade portions in the pair.

One of the cutting edges in one blade portion may be parallel to a cutting edge in an opposed blade portion when viewed in the wire pushing direction. In this embodiment, the parallel cutting edges may contact the resin coating at the same time.

If the front cutting edge of the left blade portion and the front cutting edge of the right blade portion first come into contact with the wire, then the wire is pressed in oblique directions by the respective cutting edges due to an elastic restoring force of the resin coating while the resin coating is being cut. Thus the wire is pushed along the longitudinal direction of the wire by additional pushing forces from the two cutting edges that act in directions oblique to the longitudinal axis. More particularly a force acting in an obliquely forward direction to the right is given from the front cutting edge of the left blade portion and a force acting in an obliquely forward direction to the left is given from the front cutting edge of the right blade portion.

However, in the preferred embodiment, the cutting edge on the first blade portion that initially contacts the wire and the cutting edge of the second blade portion that initially contacts the wire are parallel to each other when viewed in the wire pushing direction. Thus, these two cutting edges effectively function as a single blade. As a result, the wire pushing forces from the cutting edges cancel each other, and there is no chance of displacing the wire along the longitudinal direction.

The invention also is directed to a method for producing an insulation displacement terminal fitting. The method comprises forming slits at locations on a flat metal piece that will define folds between the side walls and the bottom wall. The method proceeds by setting three transversely extending folds in an area where each slit is formed, and embossing portions of the side walls for forming the blade portions. Portions of the metal piece that will define the side walls then are folded toward one another.

According to a preferred embodiment of the invention, substantially triangular notches are formed in portions of the plate piece that correspond to upper ends of the side walls after bending and where the blade portions are to be formed. Two inclined edges of each of the substantially triangular notches correspond to the cutting edges of the blades.

These and other objects, features and advantages of the present invention will become apparent upon reading of the following detailed description of preferred embodiments and accompanying drawings.

DETAILED DESCRIPTION OF THE PREFERRED EMBODIMENTS

Figure 1:
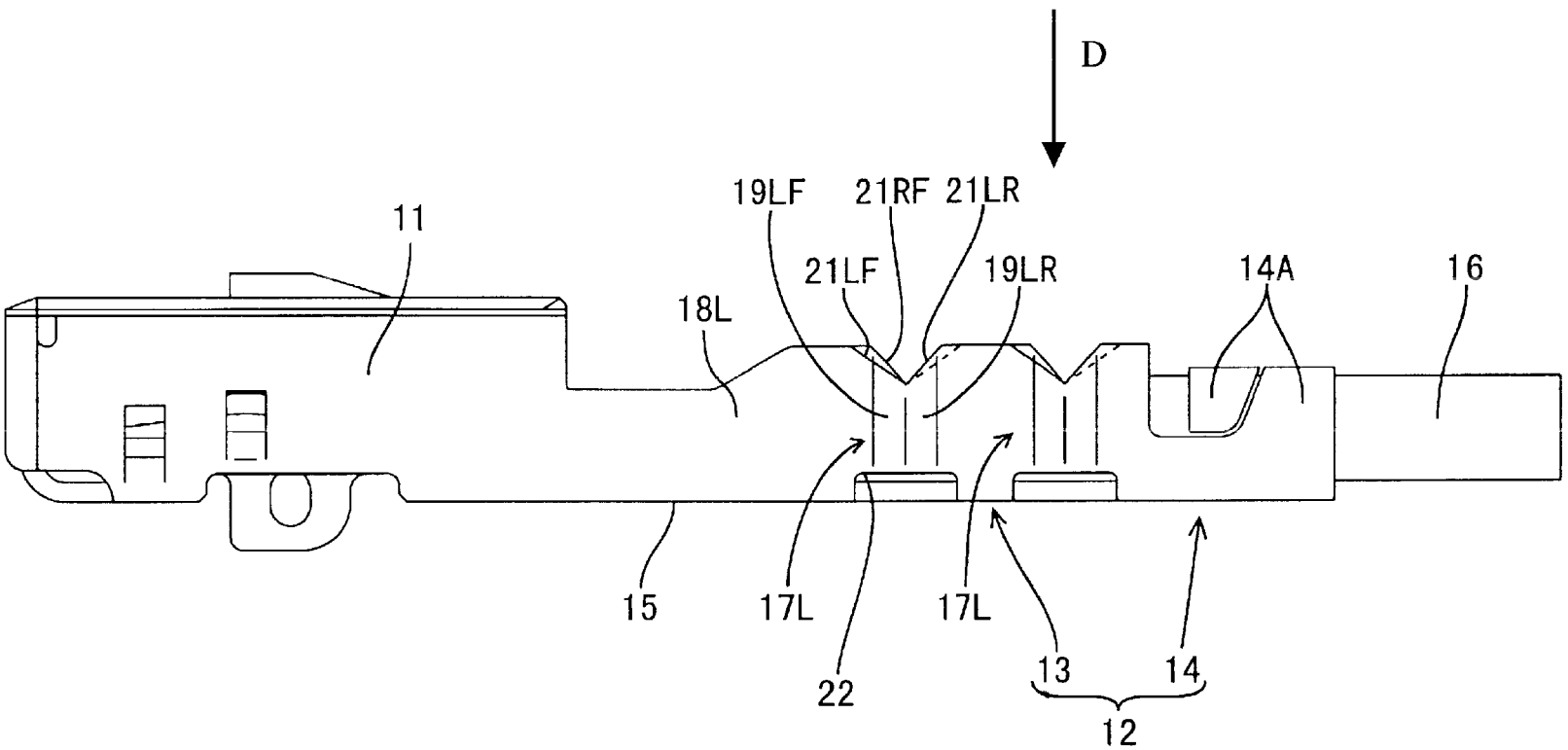
FIG. 1 is a side view of one embodiment of the invention.
Figure 2:
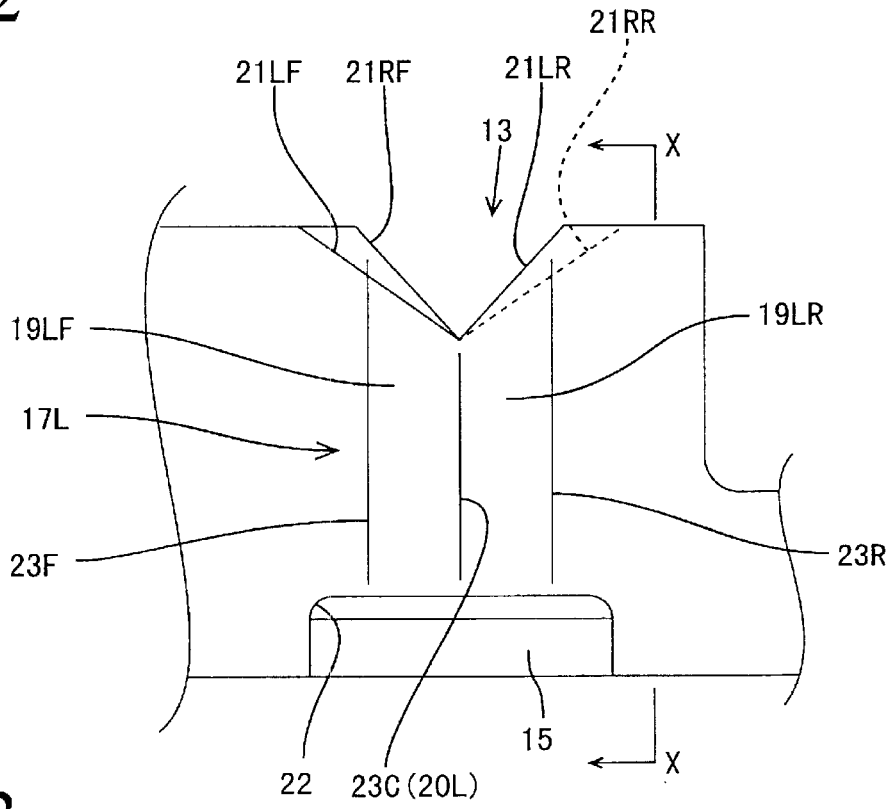
FIG. 2 is a partial enlarged side view showing blade portions.
Figure 3:
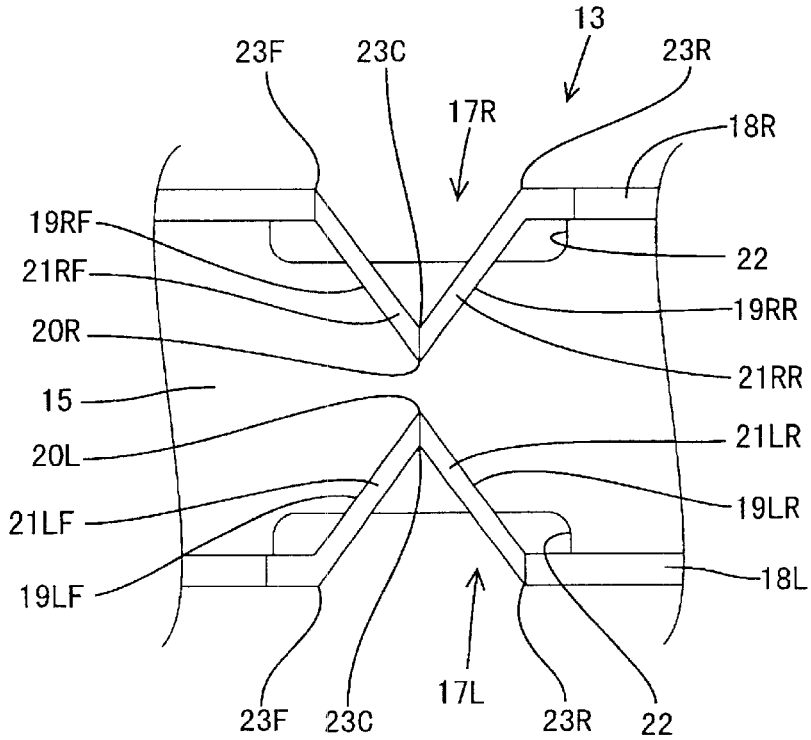
FIG. 3 is a partial enlarged plan view showing the blade portions.

In the following description, the left sides of FIGS. 1 to 3 are referred to as the front; the vertical direction is based on the orientation shown in FIGS. 1 and 2; the transverse direction is based on the orientation shown in FIGS. 4 and 5; and the right side of FIG. 3 is referred to as the upper side.

An insulation displacement terminal fitting according to this embodiment preferably is produced from a flat metal plate 10 that has conductive plating on one surface. A press or similar device then is employed to stamp or cut the plate 10 into a specified shape. The stamped or cut metal piece then is embossed and bent into the shape required for the terminal fitting. A front end portion of the insulation displacement terminal fitting is an engaging portion 11 that preferably is in the form of a substantially rectangular tube, into which an unillustrated mating terminal fitting may be inserted. A rear end portion of the terminal fitting is a wire connecting portion 12, which has an insulation displacement portion 13 at its front half and a crimping portion 14 at the rear end of the insulation displacement terminal fitting. The crimping portion 14 is comprised of a pair of crimping pieces 14A that initially stand from a bottom wall 15 and that can be crimped or deformed into connection with a wire 16.

The insulation displacement portion 13 in the illustrated embodiment is comprised of two pairs of blade portions that are referred to herein generally by the numeral 17. However, only one pair of blade portions 17 or three or more pairs of blade portions 17 may be provided. The pairs of blade portions 17 are offset from one another in forward and backward directions. However, within each pair, the blade portions are substantially opposed.

Each pair of blade portions 17 includes a right blade portion 17R and a left blade portion 17L. The respective blade portions 17R, 17L are formed by embossing, bending or deforming portions of side walls 18R and 18L inwardly into a substantially V-shape when viewed from above, or along the wire insertion direction D. The side walls 18R and 18L are collectively referred to as side walls 18 in the following description unless either one of the side walls is specified.

Each of the right blade portions 17R comprises front and rear blades 19RF and 19RR respectively. Similarly, each of the left blade portions 17L comprises front and rear blades 19LF and 19LR respectively. The blades 19RF, 19RR, 19LF and 19LR are referred to collectively as blades 19 in the following description unless any one of the blades is specified.

The blade portions 17R, 17L are provided respectively with contacting edges 20R, 20L which are referred to collectively as contacting edges 20 in the following description unless either one of the contacting edges is specified. The contacting edges 20 project vertically in the wire pushing or inserting direction D, and are disposed at projecting ends of the blades 19RF, 19RR, 19LF and 19LR most distant from the respective side walls 18R and 18L. The blade portions 17R and 17L in each pair preferably are substantially opposed to each other and are dimensioned to provide a specified spacing between the contacting edges 20R, 20L.

Cutting edges 21RF, 21RR, 21LF and 21LR are formed at locations on the respective blades 19RF, 19RR, 19LF and 19LR most distant from the bottom wall 15. The cutting edges 21RF, 21RR, 21LF, 21LR are referred to collectively as cutting edges 21 in the following description unless either one of the cutting edges is specified. As shown most clearly in FIGS. 3 and 4, the cutting edges extend from the respective contacting edges 21 to the respective side walls 18.

The wire 16 can be pushed between the pair of blade portions 17R and 17L from above at an angle that preferably is substantially normal to the longitudinal axis of the wire 16. The pushed-in wire 16 has its insulation coating 16A cut or notched by the cutting edges 21RF, 21RR, 21LF and 21LR. The contacting edges 20R, 20L then enter the cuts made in the resin coating 16A to contact the core 16B substantially at opposite sides of the wire 16.

The blade portions 17 are formed by embossing portions of the flat metal plate piece (see FIG. 6) that will become the side walls 18 when the flat metal piece has been bent by a press or similar apparatus. More particularly, slits 22 are formed at or near locations that will define the fold lines between the bottom wall 15 and the side walls 18. The slits 22 prevent the bottom wall 15 from being distorted when the side walls 18 are embossed to form the blade portions 17.

Figure 6:
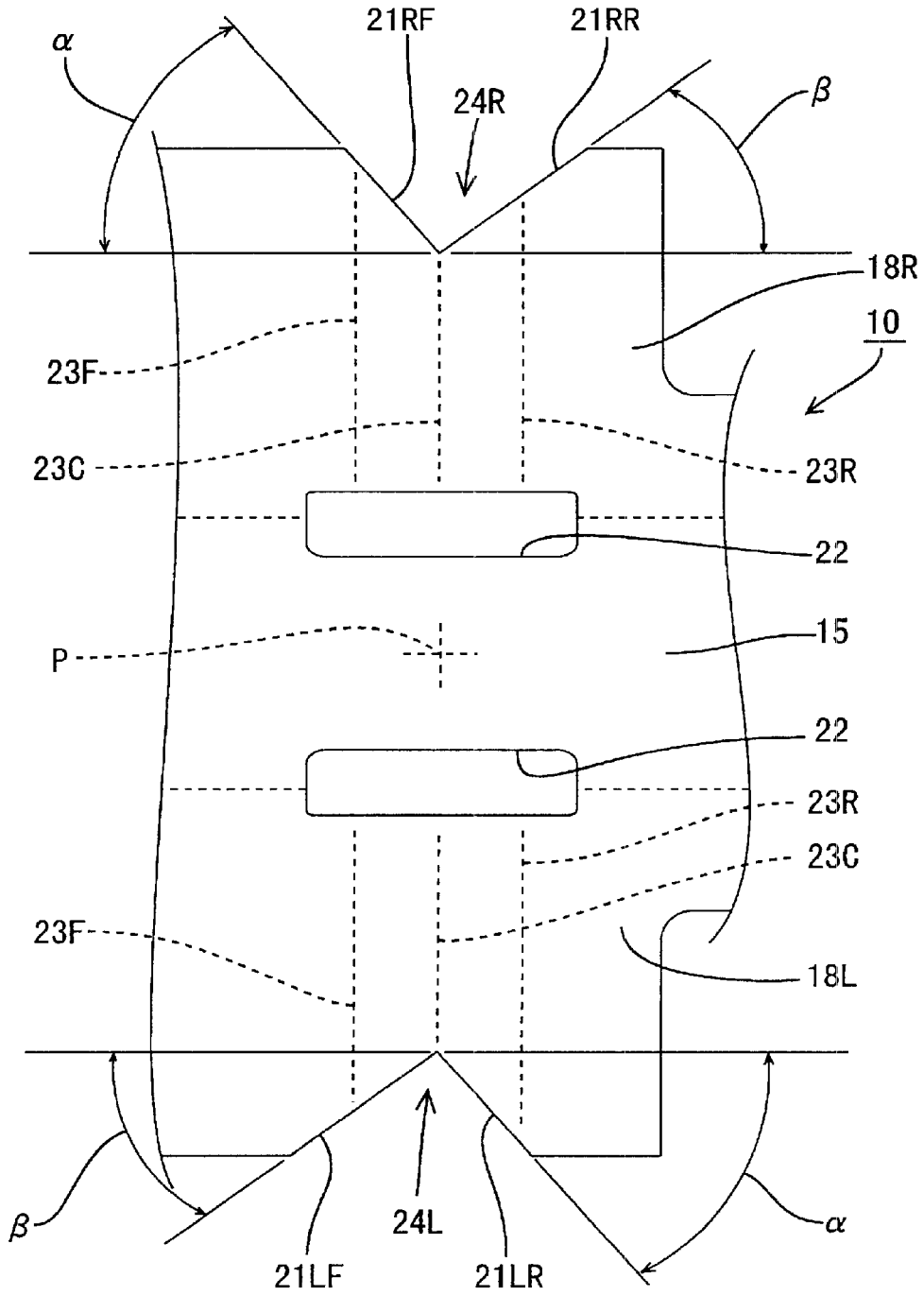
FIG. 6 is a development of a portion of a stamped-out metal plate piece which becomes blade portions.

A set of three folds 23F, 23C, 23R is formed in proximity to each slit 22. More particularly, the folds 23F, 23C and 23R in each set are disposed in portions of the metal plate that will define the respective side walls 18. Additionally, the folds 23F, 23C and 23R in each set extend substantially normal to the respective slit 22 and are set at substantially regular intervals in forward and backward directions. The two sets of folds 23F, 23C, 23R shown in FIG. 6 are formed symmetrically in the left and right side walls 18R, 18L with respect to a center longitudinal axis. The sections between the middle fold 23C and the respective front and rear folds 23F and 23R become the blades 19F and 19R of the blade portions 17, and the middle folds 23C become the contacting edges 20 of the blade portions 17.

Triangular notches 24R, 24L are formed in portions of the plate piece that become the upper ends of the side walls 18 after bending and where the blade portions 17 are to be formed. Two inclined edges of each of the notches 24R, 24L become the cutting edges 21 of the blades 19. The respective notches 24R, 24L are asymmetrical with respect to forward and backward directions as well as transverse direction.

More specifically, with reference to FIG. 6, the front end of the front cutting edge 21RF in the right notch 24R is located approximately at the intersection of the side edge of the side wall 18R and the front fold 23F. The rear end of the front cutting edge 21RF is located at the middle fold 23C. On the other hand, the front end of the rear cutting edge 21RR is located at the middle fold 23C, and hence adjacent the rear end of the front cutting edge 21RF. The rear end of the rear cutting edge 21RR is located rearward of the intersection of the rear fold 23R with the side edge of the side wall 18R. Accordingly, an angle of inclination $\alpha$ of the front cutting edge 21RF of the right notch 24R with respect to forward and backward directions is larger than an angle of inclination $\beta$ of the rear cutting edge 21RR with respect thereto. The front cutting edge 21RF with the larger angle of inclination $\alpha$ comes into contact with the resin coating 16A of the wire before the rear cutting edge 21RR does.

On the other hand, the front end of the front cutting edge 21LF at the notch 24L is located more forward than the intersection of the side edge of the side wall 18L and the front fold 23F. The rear end of the front cutting edge 21LF is located at the middle fold 23C. The front end of the rear cutting edge 21LR is located at the middle fold 23C and hence adjacent the rear end of the front cutting edge 21LF. The rear end of the rear cutting edge 21LR is located substantially at the intersection of the rear fold 23R with the side edge of the side wall 18L. Accordingly, an angle of inclination $\beta$ of the front cutting edge 21LF with respect to forward and backward directions is smaller than an angle of inclination $\alpha$ of the rear cutting edge 21LR with respect thereto. The rear cutting edge 21LF having a larger angle of inclination $\alpha$ comes into contact with the resin coating 16A of the wire before the rear cutting edge 21RR does.

The right and left notches 24R, 24L are preferably symmetrical with respect to an intersection P (FIG. 6) of a widthwise center line of the bottom wall 15 and a line connecting the two middle folds 23. Thus, the angle of inclination of the front cutting edge 21RF at the right side and the angle of inclination of the rear cutting edge 21LR at the left side are substantially the same, i.e. $\alpha$. Similarly, the angle of inclination of the rear cutting edge 21RR at the right side and the angle of inclination of the front cutting edge 21LF at the left side are substantially the same, i.e. $\beta$.

Jigs (not shown) can be placed along the respective folds 23F, 23C, 23R of the side walls 18R, 18L in the development of the metal plate piece, and the blade portions 17R, 17L can be formed by embossing e.g. by means of a press. Thereafter, the side walls 18R, 18L are bent at an angle different from 0° or 180°, preferably at a substantially right angle to the bottom wall 15 to form the insulation displacement portion 13. When the formed insulation displacement portion 13 is viewed from above, the cutting edges 21RF, 21LR that have the larger angle of inclination $\alpha$ and the cutting edges 21RR, 21LF that have the smaller angle of inclination $\beta$ are located substantially on diagonal lines, respectively, as shown in FIG. 3. It should be noted that embossing is applied such that the angles of inclinations $\alpha$, $\beta$ of the respective cutting edges 21 with respect to a horizontal line when viewed from front are the same as those in the development of the plate piece.

Figure 4:
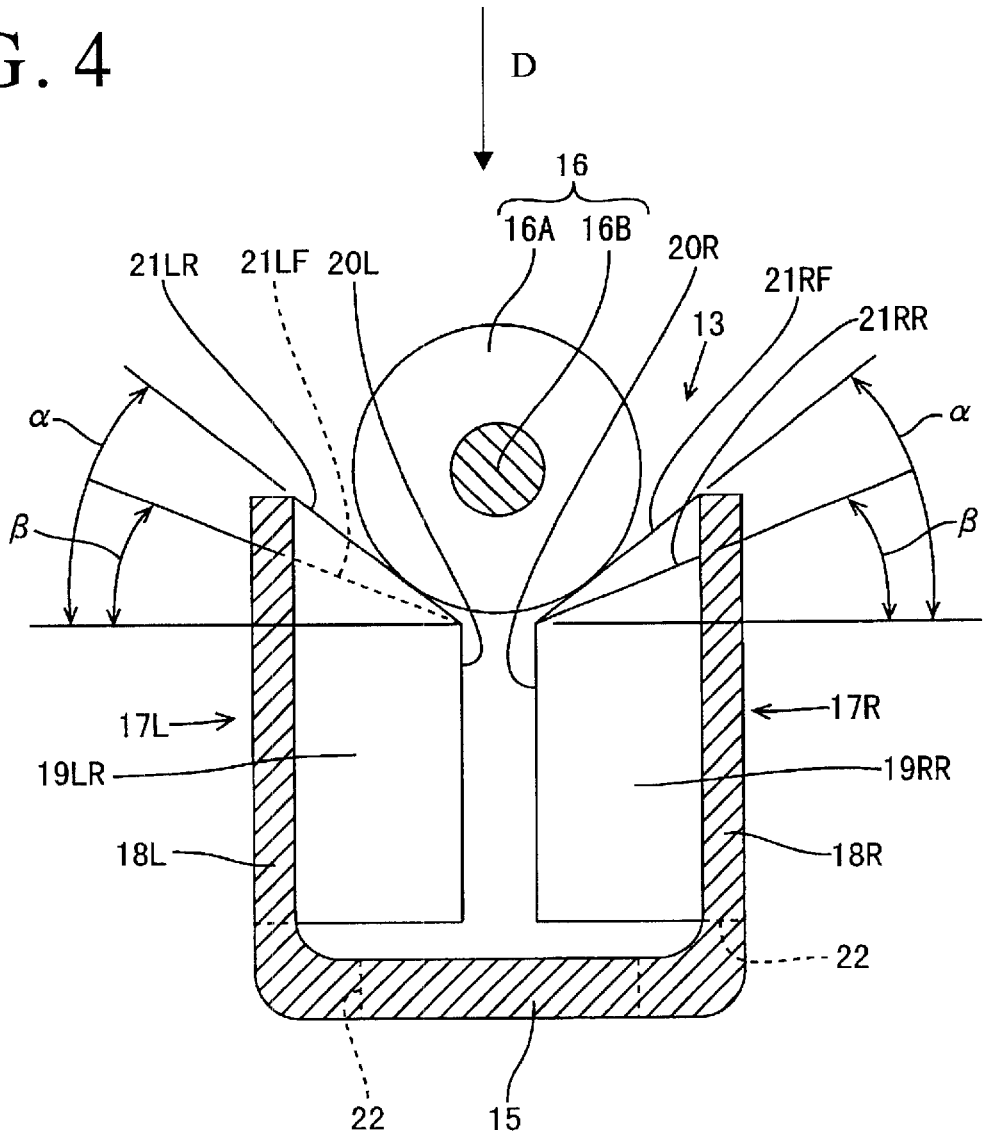
FIG. 4 is a section along X—X of FIG. 2 showing a state where a wire is in contact with cutting edges of the blades.
Figure 5:
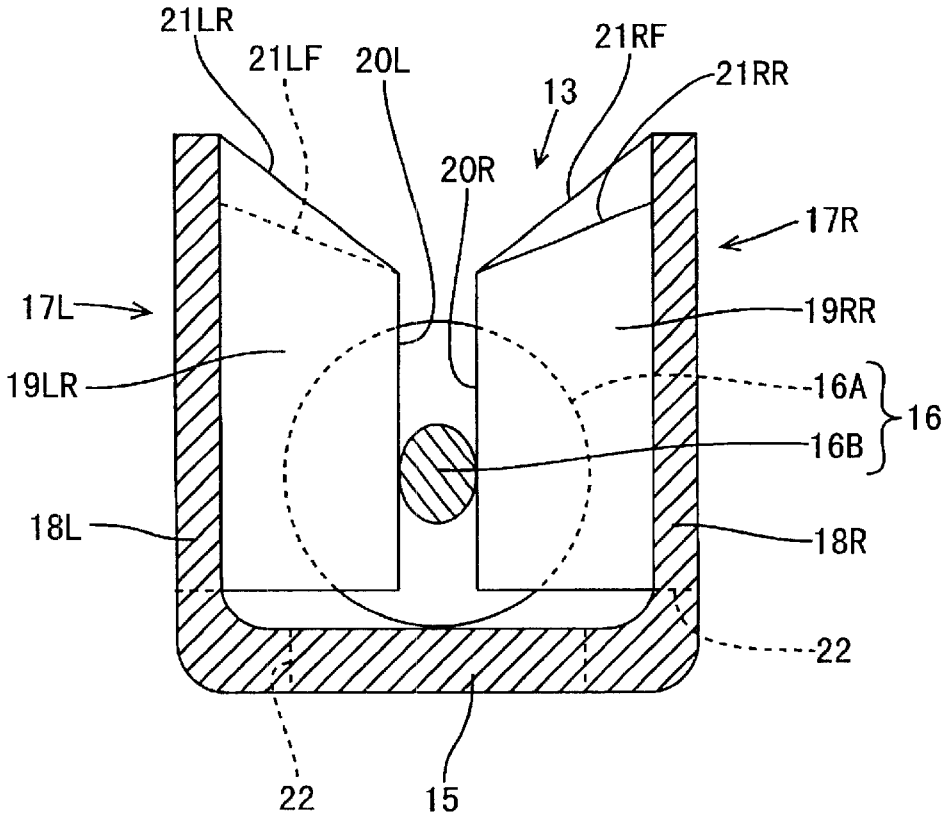
FIG. 5 is a section along X—X of FIG. 2 showing a state where the wire is pushed into connection.

A wire that is pushed into the insulation displacement portion 13 first contacts the cutting edges 21RF, 21LR with the larger angle of inclination $\alpha$, as shown in FIG. 4. These two cutting edges 21RF, 21LR preferably are substantially parallel to each other when viewed from above, as shown in FIG. 3, and thus function as if they were portions of one blade. When the wire 16 is pushed between the blade portions 17R and 17L in this state, the resin coating 16A is first cut by the cutting edges 21RF, 21LR with the larger angle of inclination $\alpha$ and then is cut by the cutting edges 21RR, 21LF with the smaller angle of inclination $\beta$. The contacting edges 20R, 20L forcibly enter the cut portions of the resin coating 16A to contact opposite sides of the core 16B.

As described above, the two V-shaped blades 19 do not simultaneously cut the resin coating 16A, but one of them first coming into contact with the resin coating 16A cuts it substantially as a single blade would do. Accordingly, insulation displacement resistance during cutting can be reduced.

Further, since a cutting operation performed by bringing one blade 19 first into contact with the resin coating 16A is performed at both the left and right blade portions 17R, 17L, an insulation displacement resistance is smaller as compared to a case where such a cutting operation is performed only at one of the blade portions 17R, 17L.

The respective cutting edges 21 of the blades 19 are inclined from the side walls 18 toward the contacting edges 20 in directions to guide the wire 16 when viewed in the longitudinal direction of the wire 16. Thus, the position of the wire 16 can be corrected to a widthwise center position even if the wire 16 is displaced with respect to the widthwise direction, thereby avoiding an erroneous cutting operation and a contact failure between the blade portions 17 and the core 16B.

The cutting edge of the right blade portion 17R that first contacts the wire 16 and the cutting edge of the left blade portion 17L that first contacts the wire 16 could be positioned to form a V-shape together when viewed in the wire pushing direction (e.g. the front cutting edge 21RF of the right blade portion 17R and the front cutting edge 21LF of the left blade portion 17L could first contact the wire 16). In this case, the wire 16 is pressed in oblique directions by the respective cutting edges due to an elastic restoring force of the resin coating 16A while the resin coating 16A is being cut. Thus the wire 16 would be pushed along the longitudinal direction (e.g. forward) of the wire 16 by additional pushing forces from the two cutting edges which act in oblique directions toward the longitudinal axis (e.g. a force acting in an obliquely forward direction to the left is given from the front cutting edge 21RF of the right blade portion 17R and a force acting in an obliquely forward direction to the right is given from the front cutting edge 21LF of the left blade portion 17L.

However, in the illustrated embodiment, the cutting edge 21RF of the right blade portion 17R that first contacts the wire 16 and the cutting edge 21LR of the left blade portion 17L that first contacts the wire 16 are positioned substantially parallel to each other when viewed in the wire pushing direction. These two cutting edges 21RF and 21LR cut the resin coating substantially as a single blade would. As a result, the wire pushing forces from the cutting edges 21RF, 21LF cancel each other, and there is no chance of displacing the wire 16 along the longitudinal direction.

The present invention is not limited to the above embodiment. For example, following embodiments are also embraced by the technical scope of the invention as defined in the claims. Besides these embodiments, various changes can be made without departing from the scope and spirit of the invention as defined in the claims.

The cutting edges of the two blades forming a V-shape are inclined with respect to the wire pushing direction in the foregoing embodiment. However, the heights of these cutting edges from the bottom wall may differ by causing one or both of the cutting edges to extend substantially normal to the wire pushing direction.

The cutting edges of the two blades have the substantially same height at the contacting edge while having different heights at the side wall when viewed in the longitudinal direction of the wire in the foregoing embodiment. However, the blades may have the same height at the side wall while having different heights at the contacting edge or the blades may have different heights both at the side wall and at the contacting edge. In the case that the cutting edges have different heights both at the side wall and at the contacting edge, the two cutting edges may intersect with each other in their intermediate positions when viewed in the longitudinal direction of the wire.

The contacting timings of the two blades with the resin coating are differed by differing the angles of inclination of these blades in the foregoing embodiment. However, the heights may differ by forming them to have the same angle of inclination.

What is claimed is:

1. An insulation displacement terminal fitting for use with a wire having a longitudinal axis, a core extending along the longitudinal axis, and an insulation coating surrounding the core, the insulation displacement terminal fitting comprising:

a pair of substantially opposed blade portions, each said blade portion comprising two blades intersecting at a contacting edge, the contacting edges of the respective blade portions being substantially parallel and spaced apart sufficiently for engaging the core of the wire moved in a direction substantially normal to the longitudinal axis and substantially parallel to the contacting edges in a wire pushing direction, each said blade having a cutting edge substantially facing the wire pushing direction for cutting the insulation coating of the wire so that the core of the wire can be brought into contact with the contacting edges, the cutting edges of the blades being arranged relative to the cutting direction for contacting the insulation coating at different timings while the wire is being pushed in.

2. An insulation displacement terminal fitting according to claim 1, wherein the insulation displacement terminal fitting comprises side walls, the blades being formed by bending portions of side walls of the insulation displacement terminal fitting inwardly.

3. An insulation displacement terminal fitting according to claim 2, wherein the blade portions are substantially V-shaped when viewed in the wire pushing direction.

4. An insulation displacement terminal fitting according to claim 2, wherein the contacting edges extend continuously in the wire pushing direction from the cutting edges of the two blades.

5. An insulation displacement terminal fitting according to claim 2, wherein the cutting edges of the two blades form a substantially V-shape and are inclined from a corresponding side wall of the insulation displacement terminal fitting toward the corresponding contacting edge in such directions as to laterally guide the wire, and wherein the contacting timings of the cutting edges of the two blades with the insulation coating are differed by differing angles of inclination of the cutting edges.

6. An insulation displacement terminal fitting according to claim 1, wherein contacting timings of the cutting edges of the two blades with the insulation coating are differed by differing the position at which the blades are positioned along the wire pushing direction.

7. An insulation displacement terminal fitting according to claim 1, wherein the cutting edges of the two blades form a substantially a V-shape and are arranged at both of the one pair of blade portions to contact the insulation coating at different timings while the wire is being pushed in.

8. An insulation displacement terminal fitting according to claim 1, wherein the cutting edges on the pair of opposed blade portions when viewed in the wire pushing direction contact with the insulation coating at substantially the same timing.

9. An insulation displacement terminal fitting according to claim 1, wherein the cutting edges on the pair of opposed blade portions are substantially parallel to each other.

10. An insulation displacement terminal fitting unitarily formed from a metal plate and comprising: a bottom wall, first and second side walls projecting from said bottom wall such that a wire receiving space is defined between the side walls, each said side wall having at least one V-shaped blade portion formed thereon and projecting into the wire receiving space between the side walls, the blade portions each comprising first and second blades intersecting at a contacting edge, the blade portions being disposed on the respective side walls such that the respective contacting edges are in substantially opposed facing relationship to one another, a cutting edge being formed at locations on each said blade most distant from the bottom wall, the cutting edges extending from the respective contacting edge to the respective side wall and being aligned at angles of alignment to the respective contacting edges, the angles of alignment in each said blade portion being different from one another, such that a wire inserted into the wire receiving space first contacts one cutting edge of each said blade portion and then contacts the other of the cutting edges of the respective blade portion.

11. The insulation displacement terminal fitting of claim 10, wherein the angles of alignment between each said contacting edge and the respective cutting edges of each said blade portion define a small angle and a large angle, the cutting edge on the first side wall that defines the large angle of alignment being substantially parallel to the cutting edge that defines the large angle of alignment in the second side wall.

12. The insulation displacement terminal fitting of claim 11, wherein the angles of alignment between each said contacting edge and the respective cutting edges of each said blade portion define a small angle and a small angle, the cutting edge on the first side wall that defines the small angle of alignment in being substantially parallel to the cutting edge that defines the small angle of alignment in the second side wall.

13. An insulation displacement terminal fitting of claim 10, further comprising at least one slit between the bottom wall and the respective blade portions.

14. The insulation displacement terminal fitting of claim 10, wherein the opposed contacting edges are substantially parallel to one another.

* * * * *